US006527236B1

(12) United States Patent
Situ

(10) Patent No.: US 6,527,236 B1
(45) Date of Patent: Mar. 4, 2003

(54) CORNER BRACKET

(76) Inventor: Yuan Rui Situ, 920 Centennial St., #5, Los Angeles, CA (US) 90012

( * ) Notice: Subject to any disclaimer, the term of this patent is extended or adjusted under 35 U.S.C. 154(b) by 0 days.

(21) Appl. No.: 10/199,571

(22) Filed: Jul. 19, 2002

(51) Int. Cl.[7] ..... A47B 96/06

(52) U.S. Cl. ..... 248/220.1; 248/231.7; 248/230.9; 248/229.14; 248/228.1; 403/49; 403/169; 403/217; 403/231

(58) Field of Search ..... 248/231.71, 229.14, 248/220.1, 220.21, 227.3, 230.1, 230.9, 231.85, 228.1, 228.5, 226.11, 219.4, 219.1; 403/49, 169, 217, 231

(56) References Cited

U.S. PATENT DOCUMENTS 2,946,546 A * 7/1960 Pokorny et al. ..... 248/534
3,142,501 A * 7/1964 Clark et al. ..... 285/184
4,129,088 A * 12/1978 Foley, Jr. ..... 440/63
4,460,142 A * 7/1984 O'Rorke ..... 248/230.8
4,860,985 A * 8/1989 Olson et al. ..... 248/229.17
4,864,795 A * 9/1989 Burg ..... 52/646
5,230,491 A * 7/1993 Tseng ..... 248/188.1
5,305,571 A * 4/1994 Trevino ..... 52/653.2
5,575,580 A * 11/1996 Parrish et al. ..... 403/49
5,577,694 A * 11/1996 Lee ..... 248/188
5,785,447 A * 7/1998 Fonti et al. ..... 403/49
6,047,934 A * 4/2000 Roy et al. ..... 248/231.71
6,357,709 B1 * 3/2002 Parduhn ..... 248/229.17

* cited by examiner

*Primary Examiner*—Kimberly Wood
(74) *Attorney, Agent, or Firm*—Joe Nieh

(57) ABSTRACT

A corner bracket comprising of two matching components held together by two bolts wherein as the two bolts are tightened, the two matching components will be urged toward each other thereby securely gripping a planar surface that is inserted between them. Another bolt is inserted through an opening in the second component through a threaded hole in the first component and protrudes into a hole in the first component where the vertical supporting member is inserted. The bolt will securely lock the corner bracket with the planar surface to the vertical supporting member inserted through the hole in the first component. The advantage of the present invention is that the force of the grip on the planar surface can be adjusted independently of the force of the grip on the vertical supporting member. Another advantage of the present invention is that the corner bracket can be used to secure a variety of planar surfaces with a relative large range of thickness.

4 Claims, 3 Drawing Sheets

CORNER BRACKET

BACKGROUND-FIELD OF INVENTION

The present invention relates generally to a bracket to attach a corner of a planar surface to a vertical member that will support the planar surface. More particularly, the present invention is a corner bracket that can be used to attach a planar surface to a vertical member which will act as a supporting member that can support the planar surface.

BACKGROUND-DESCRIPTION OF RELATED ART

Conventional corner bracket generally comprises of two metallic components. The first component has a large hole, generally with a circular profile, through its body to allow insertion of the vertical member that will be supporting the planar surface. A small portion of the wall of the first component that defines the large hole has a cut-out that exposes the surface of the vertical member when it is inserted into the large hole.

The second component has a profile that will match the first component such that when they are attached together with two bolts they form a functional unit that will hold the planar surface to the vertical member. The second component has two holes angled at forty-five degrees to the planar surface. Two matching bolts are inserted through the two holes into two threaded holes in the first component oriented to match the two holes in the second component thereby, by tightening the two bolts in the threaded holes, the two components will be pulled toward each other such that a planar surface of varying thickness may be sandwiched and held between the two components. Another larger bolt is threaded through another larger hole in the second component between the two bolts such that as the larger bolt is threaded further into the second component, it will protrude into the cut-out in the first component and secure the corner bracket to the vertical member supporting the planar member.

This conventional design has several inherent limitations and has limited applications. First, the larger bolt that is used to secure the corner bracket to the vertical member tends to separate the two components as the larger bolt is tightened in an attempt to securely lock onto the vertical member. The larger bolt also directly opposes the two bolts that are used to hold the two components together. Furthermore, as the two components are forced apart by the larger bolt, the corner bracket will loosen its grip on the planar surface. Therefore, the larger bolt and the two bolts are always resisting each other and a compromise between the grip on the planar surface and the grip on the vertical member must be reached. This conventional design can only be used on a very limited range of thin and relatively light weight planar surfaces.

SUMMARY OF THE INVENTION

The present invention is a corner bracket comprising of two matching components held together by two bolts wherein as the two bolts are tightened, the two matching components will be urged toward each other thereby securely gripping a planar surface that is inserted between them. Another bolt is inserted through an opening in the second component through a threaded hole in the first component and protrudes into a hole in the first component where the vertical supporting member is inserted. The bolt will securely lock the corner bracket with the planar surface to the vertical supporting member. The advantage of the present invention is that the force of the grip on the planar surface can be adjusted independently of the force of the grip on the vertical supporting member. Another advantage of the present invention is that the corner bracket can be used to secure a variety of planar surfaces with a relative large range of thickness.

DETAILED DESCRIPTION OF THE PREFERRED EMBODIMENT

Figure 1:
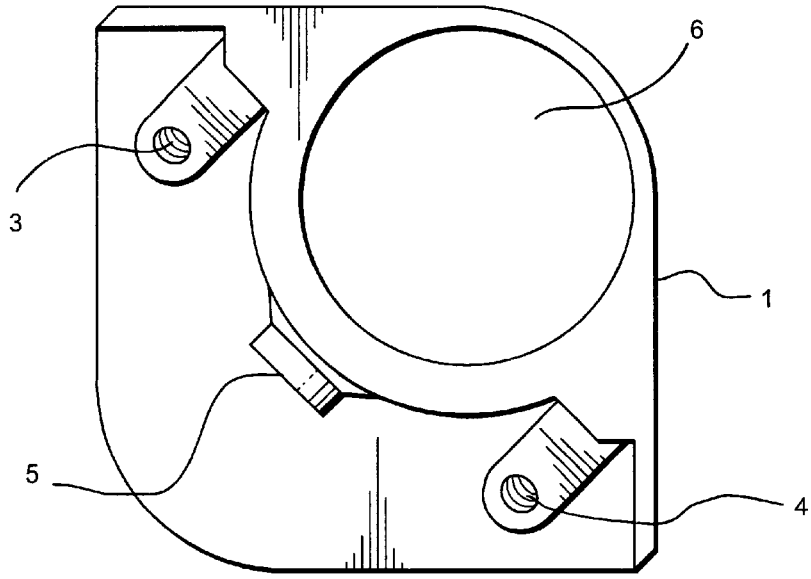
FIG. 1 shows the bottom view of the first component of the present invention.
Figure 2:
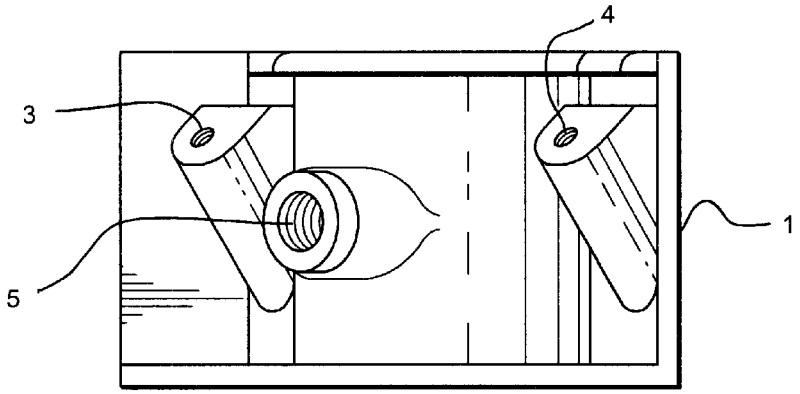
FIG. 2 shows the front view of the first component of the present invention.
Figure 3:
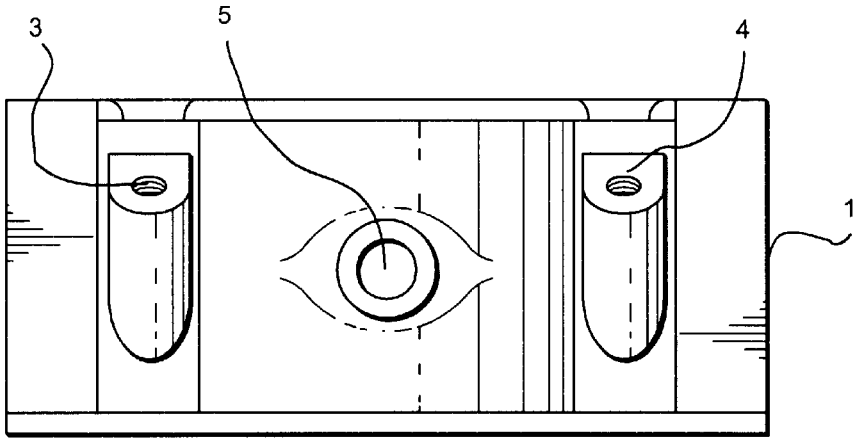
FIG. 3 shows the first component of the present invention as viewed directly at the threaded hole through the body of the first component.
Figure 4:
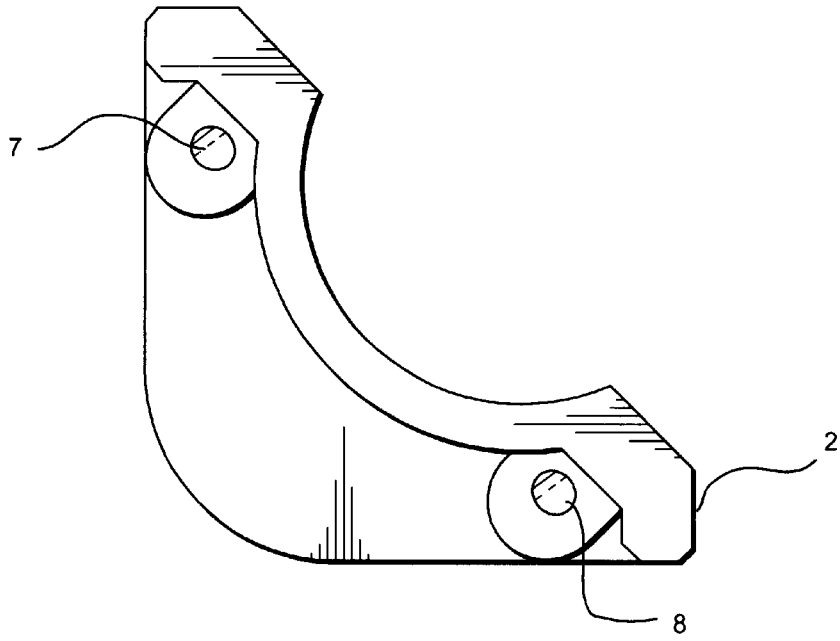
FIG. 4 shows the bottom view of the second component of the present invention.
Figure 5:
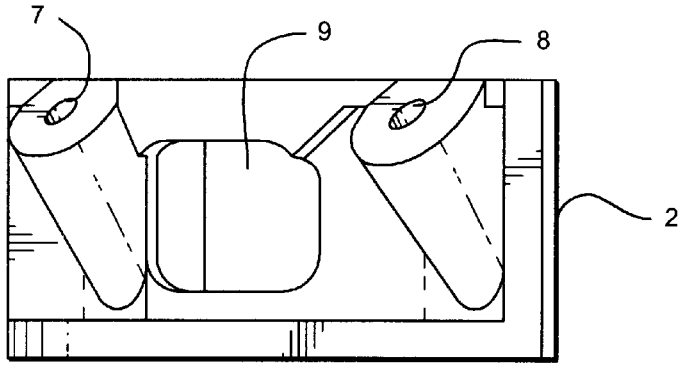
FIG. 5 shows front view of the second component of the present invention.
Figure 6:
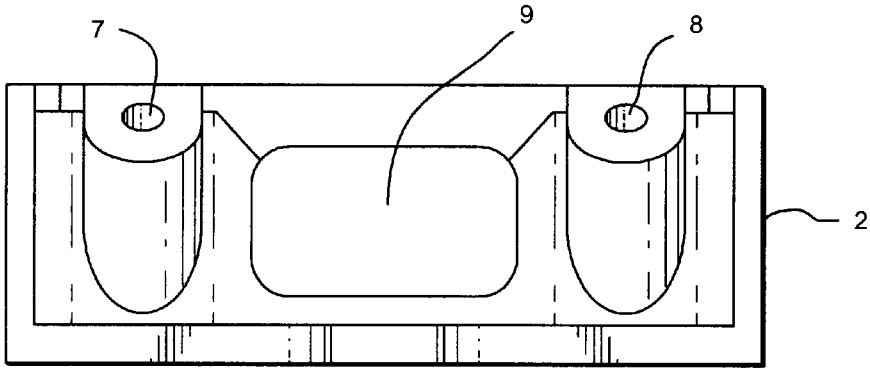
FIG. 6 shows second component of the present invention as viewed directly at the opening that exposes the threaded hole through the body of the first component.
Figure 7:
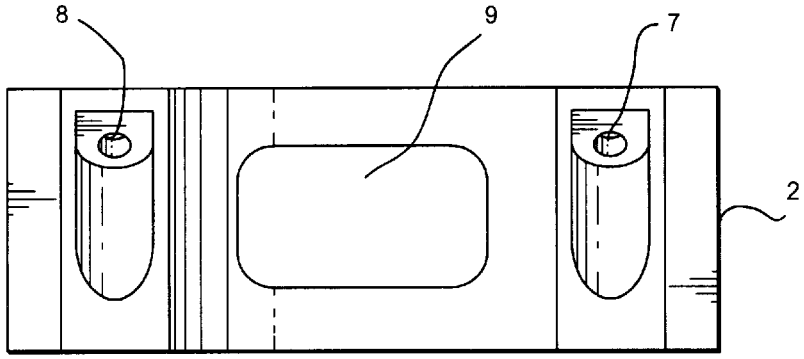
FIG. 7 shows second component of the present invention as viewed from the rear directly at the opening that exposes the threaded hole through the body of the first component.
Figure 8:
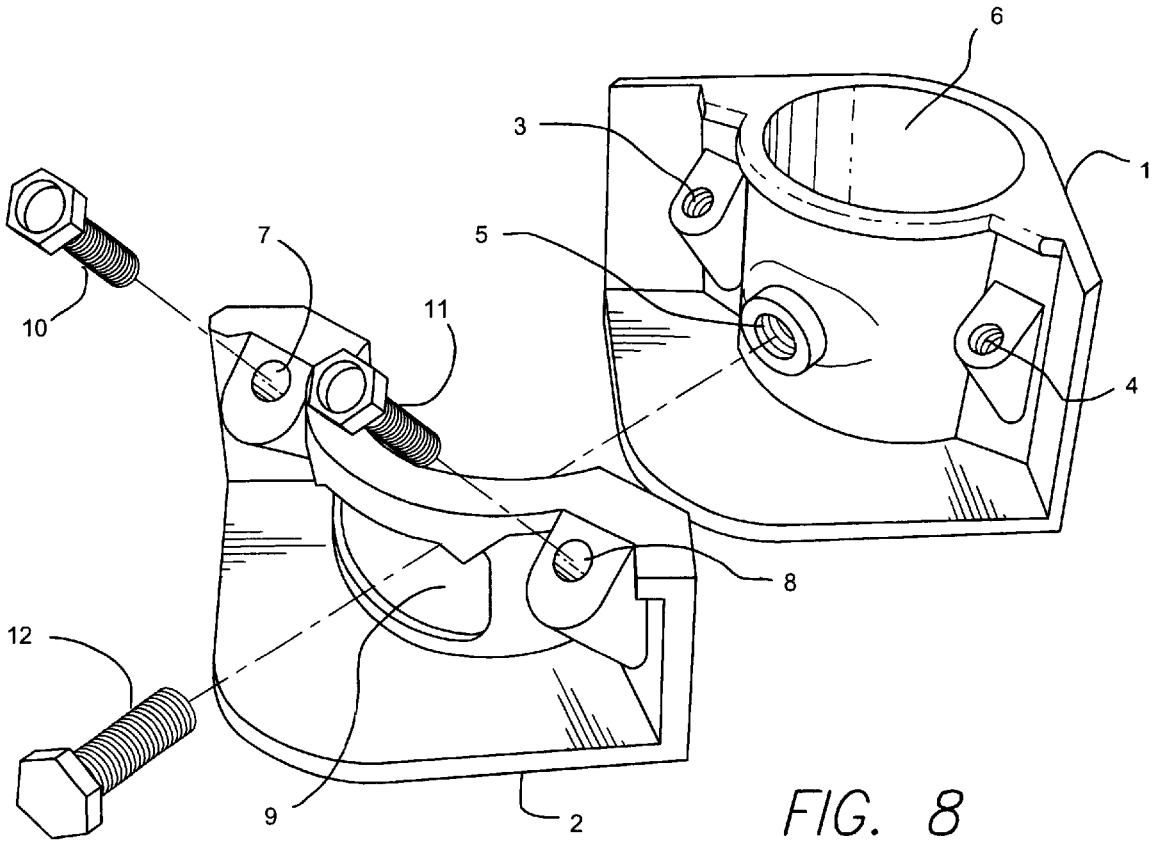
FIG. 8 shows the assembly of the two component of the present invention.

The preferred embodiment of the present invention comprises of two components. The first component 1 has a first threaded hole 3, a second threaded hole 4, and a third threaded hole 5. The first component 1 also has a hole for the vertical supporting member 6.

The second component 2 has a fourth hole 7 and a fifth hole 8. The second component 2 also has an opening 9 that exposes the third threaded hole 5 in the first component 1 when the two component are assembled.

The first component 1 and the second component 2 are held together with a first bolt 10 and a second bolt 11. A third bolt 12 is inserted through the opening 9 in the second component 2 into the third threaded hole 5 in the first component 1 and protrudes into the hole for the vertical supporting member 6. As the first bolt 10 and the second bolt 11 is tightened, the first component 1 and the second component 2 will be urged to come toward each other. As the first component 1 and the second component 2 is urged together, they will clamp onto the planar surface inserted between them and held the planar surface securely between them.

As the third bolt 12 is tightened, it protrudes into the hole for the vertical supporting member 6 thereby securely locking the planar surface held between the two components to the vertical supporting member. Any number of desired corner brackets may be used in this manner to securely attach vertical supporting members to the planar surface to support the planar surface.

Since the first bolt 10 and the second bolt 11 that is utilized to urge the first component 1 and the second component 2 together and to secure the planar surface operates independently of the third bolt 12 that is used to secure the corner bracket to the vertical supporting member, the force of the grip on both the planar surface and the vertical supporting member can be adjusted independently and adjusting one will not affect the other.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A corner bracket comprising:

a first component with multiple threaded holes and a hole for the insertion of a vertical supporting member; and a second component with multiple holes matching the multiple threaded holes in the first component and an opening exposing one or more threaded holes in the first component;

wherein the second component is urged toward the first component by multiple bolts threaded through the matching threaded holes in the first component and the holes in the second component to securely grip a planar surface between them and wherein one or more bolts are inserted through the opening in the second component and through the threaded holes in the first component protruding into the hole for the vertical supporting member to securely attach the corner bracket to the vertical supporting member.

2. A corner bracket according to claim 1, wherein the multiple threaded holes in the first component and the multiple holes matching the multiple threaded holes in the second component are at an angle of approximately forty-five degrees.

3. A corner bracket comprising:

a first component with a first threaded hole, a second threaded hole, and a third threaded hole and a hole for the insertion of a vertical supporting member; and a second component with two holes matching the first threaded hole and the second threaded hole in the first component and an opening exposing the second threaded hole in the first component;

wherein the second component is urged toward the first component by the two bolts threaded through the matching threaded holes in the first component and the holes in the second component to securely grip a planar surface between them and wherein a bolt is inserted through the opening in the second component and through the third threaded hole in the first component protruding into the hole for the vertical supporting member to securely attach the corner bracket to the vertical supporting member.

4. A corner bracket according to claim 3, wherein the first threaded hole and the second threaded hole in the first component and the two holes matching the first threaded hole and the second threaded hole in the second component are at an angle of approximately forty-five degrees.

* * * * *